US007635208B2

(12) United States Patent
Hedrick

(10) Patent No.: US 7,635,208 B2
(45) Date of Patent: Dec. 22, 2009

(54) MODULAR UTILITY LIGHT

(75) Inventor: Paul Hedrick, Benton, KY (US)

(73) Assignee: Multiway Industries Ltd., Tsuen Wan, Hong Kong (CN)

( * ) Notice: Subject to any disclaimer, the term of this patent is extended or adjusted under 35 U.S.C. 154(b) by 14 days.

(21) Appl. No.: 12/077,430

(22) Filed: Mar. 19, 2008

(65) Prior Publication Data

US 2009/0016049 A1 Jan. 15, 2009

Related U.S. Application Data

(60) Provisional application No. 60/919,265, filed on Mar. 21, 2007.

(51) Int. Cl.
*F21V 21/08* (2006.01)

(52) U.S. Cl. ..... 362/399; 362/185; 362/196; 362/400; D26/37; D26/113; 16/110.1; 439/476.1

(58) Field of Classification Search ..... D26/37, D26/113; 16/110.1; 362/185, 196, 399, 362/400; 439/476.1
See application file for complete search history.

(56) References Cited

U.S. PATENT DOCUMENTS 4,141,062 A * 2/1979 Trueblood ..... 362/400
4,774,647 A * 9/1988 Kovacik et al. ..... 362/295
5,369,559 A * 11/1994 Hedrick et al. ..... 362/376
5,833,357 A * 11/1998 Ting ..... 362/378

* cited by examiner

*Primary Examiner*—Stephen F Husar
(74) *Attorney, Agent, or Firm*—Frost Brown Todd LLC

(57) ABSTRACT

A modularly constructed hand held, utility light is described and taught having a sealed electrical module and a separately attached hand-hold module. The hand-hold module includes two half shells that when assembled and attached to the electric module completes the utility light.

9 Claims, 5 Drawing Sheets

MODULAR UTILITY LIGHT

RELATED APPLICATIONS

This application claims the priority of Provisional Patent Application Ser. No. 60/919,265 entitled Modular Utility Light," Filed on Mar. 21, 2007.

TECHNICAL FIELD

The present invention relates to an improved hand held utility light. More particularly the present invention relates to a modularly constructed handle for the utility light which allows for design of individual hand hold configurations, as requested by given customers, without the need for separate UL testing and approval for each individually configured light.

BACKGROUND OF THE INVENTION

Hand held utility lights typically comprise two half-shells which when assembled encapsulate therebetween the light bulb receptacle, the light on-off switch, and any other desired brass circuitry. For example see U.S. Pat. No. 5,833,357.

However, when manufacturing such utility lights for differing customers, each customer generally requires that the hand-hold portion of the utility light be uniquely different from their competitors. Thus manufacturing suppliers of such utility lights must individually submit each uniquely designed utility light for UL testing and approval even though the electrical portions of each utility light may be identical to that of previously approved utility lights.

In the event that a given customer desires to reconfigure their particular utility light handle, the entire newly configured utility light must be UL tested and approved even though the redesign is superficial and incorporates previously approved electrical components and circuitry.

Thus for manufacturers supplying multiple customers, such individual UL testing and approvals becomes costly and generally unnecessary.

BRIEF SUMMARY OF THE INVENTION

By the present invention a uniquely configured utility light is taught which will not require separate UL testing and approval when the overall appearance of the hand hold portion of the utility light is the only portion of the utility light that is reconfigured.

The present invention teaches a unique hand held utility light having a modular construction wherein the light includes an electrical module and a separately constructed hand hold module, thereby compressing a separate hand hold module connected to an electrical module to complete the light structure.

By this modular construction the utility light manufacturer need only submit the electrical module for UL testing and approval. Once UL tested and approved, the electrical module may be used with any uniquely designed hand hold module without separate UL testing and approval. Of the complete utility light

DESCRIPTION OF THE INVENTION

Figure 1:
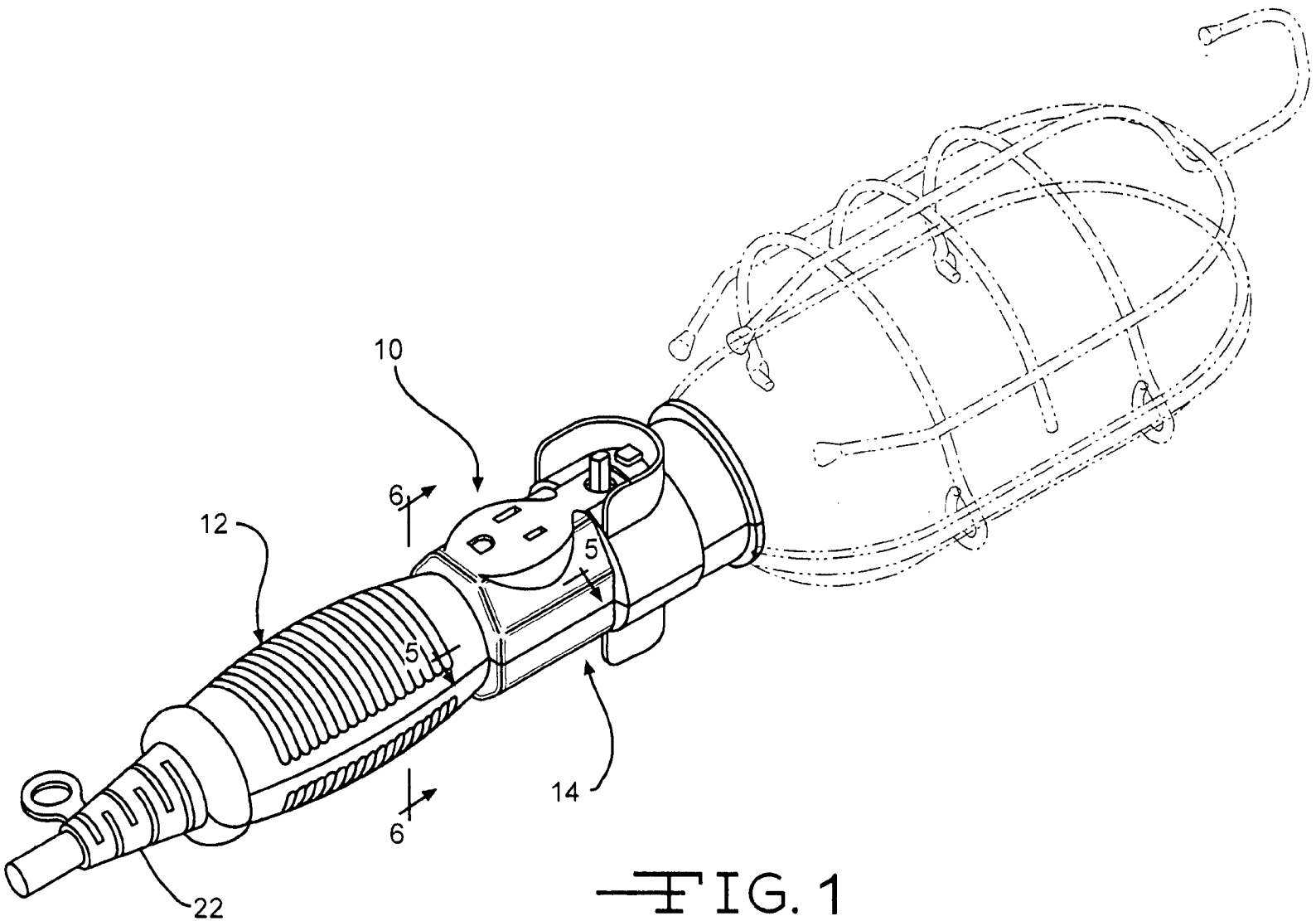
FIG. 1 presents a pictorial view of a typical utility light embodying the present invention.
Figure 2:
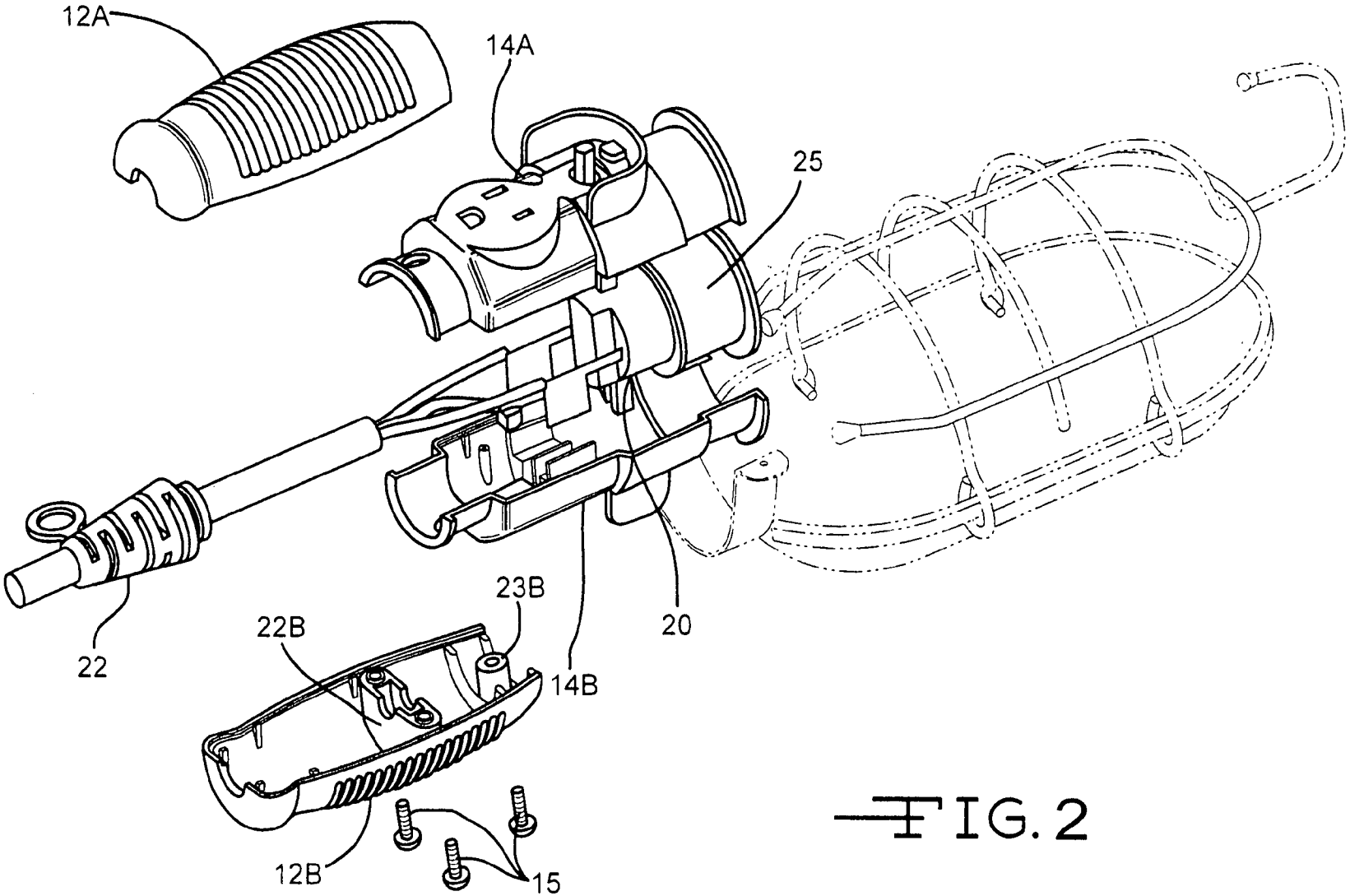
FIG. 2 presents an exploded pictorial view of the utility light illustrated in FIG. 1.
Figure 3:
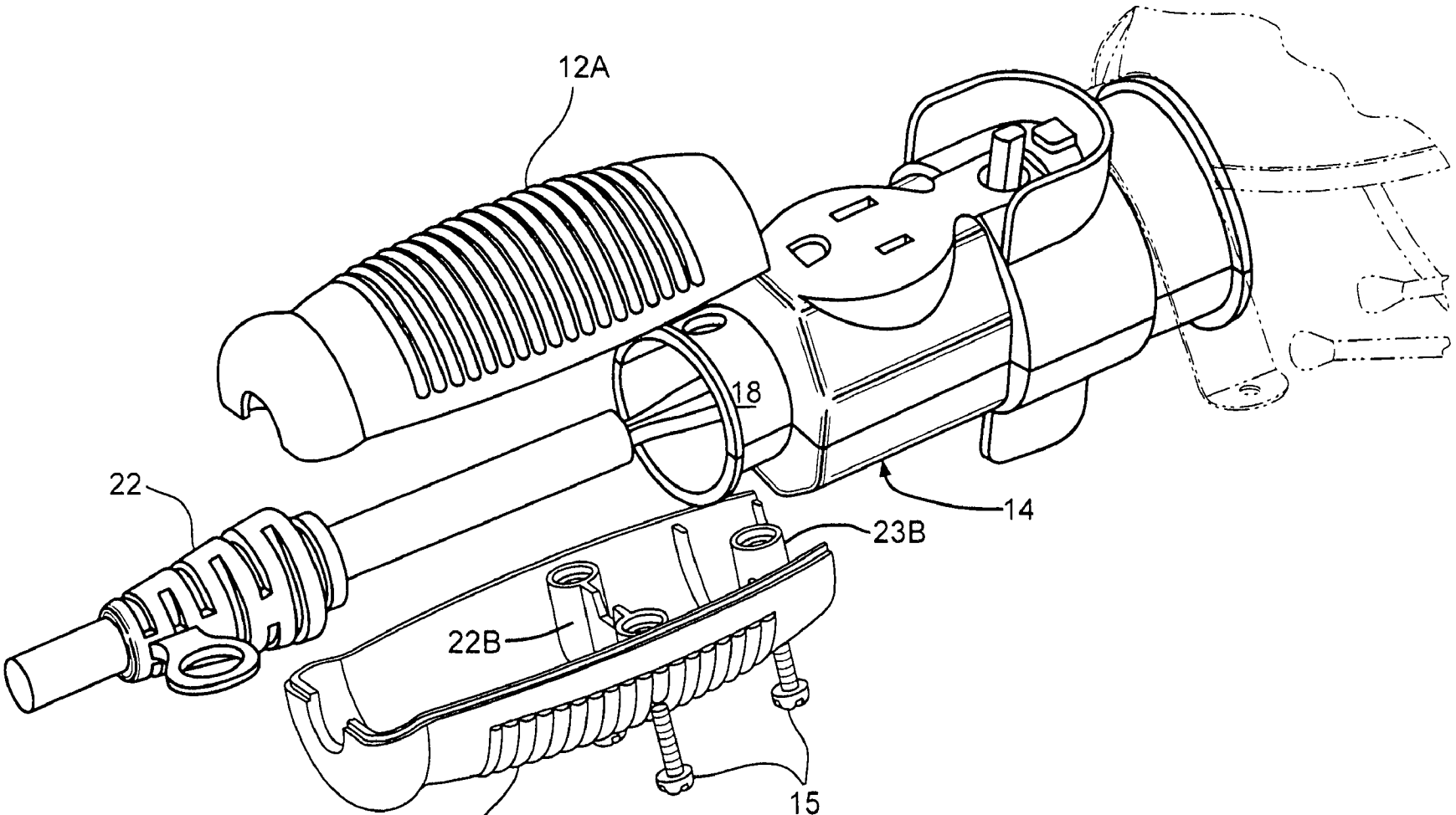
FIG. 3 presents an exploded pictorial view illustrating the assembly of the utility light illustrated in FIG. 1.
Figure 4:
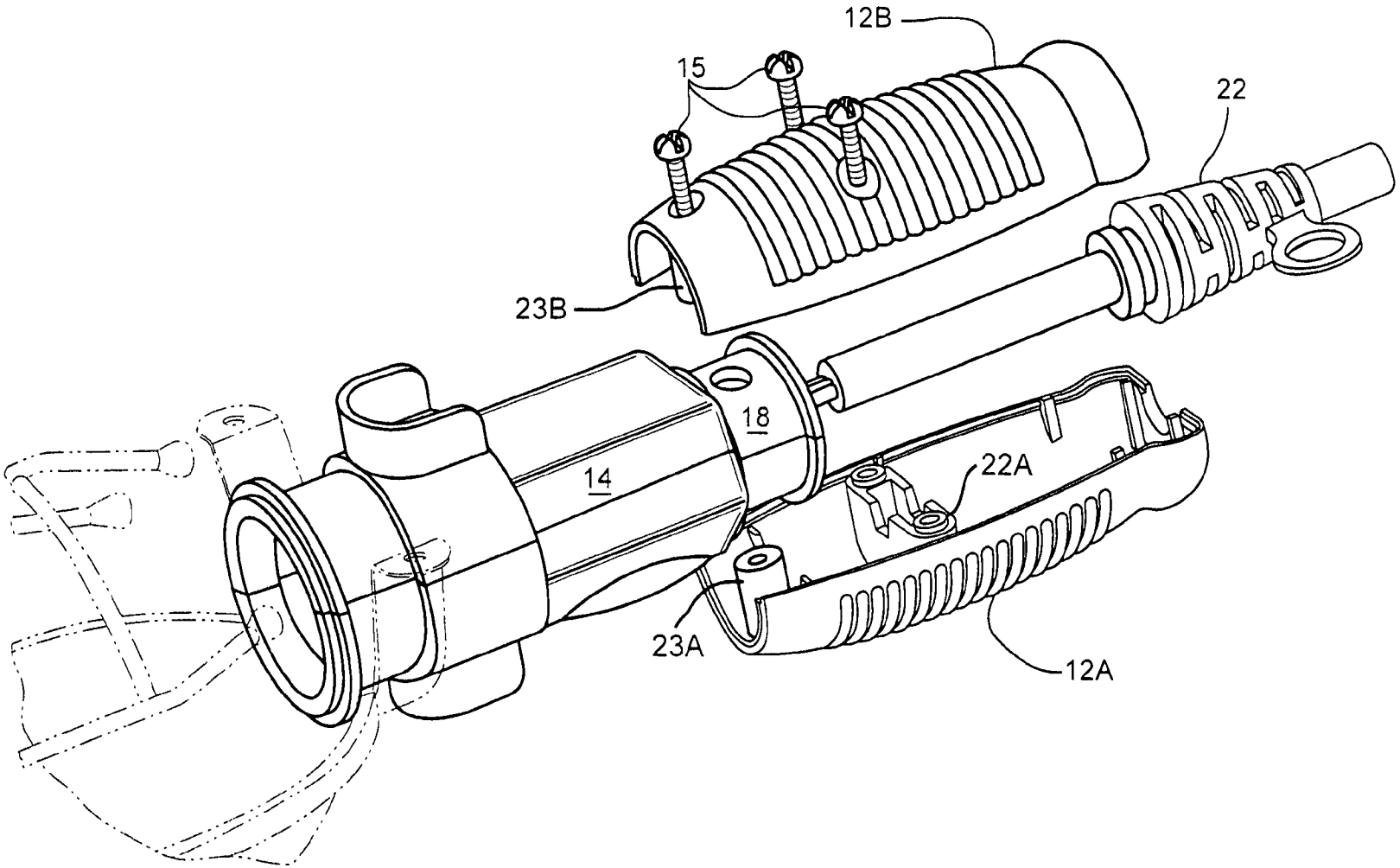
FIG. 4 presents a reverse and inverted pictorial view of FIG. 3.
Figure 6:
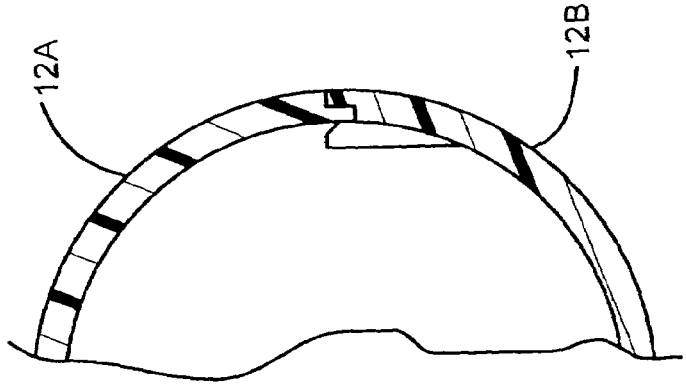
FIG. 6 presents a crossectional view taken along line 6-6 in FIG. 1.

FIG. 1 illustrates a utility light 10 comprising a handle module 12 and an electrical module 14. As illustrated in FIGS. 2, 3 and 4 handle module 12 comprises half shells 12A and 12B that when placed together, as illustrated in FIG. 6, and fastened with fasteners 15, complete the assembly of handle module 12.

Similarly, as illustrated in FIG. 2, electrical module 14 comprises two opposing shells 14A and 14B that permanently, combine to form an outer housing for electrical module 14. As illustrated, shells 14A and 14B, when assembled, encapsulate any desired brass electrical components 20 and the light bulb receptacle 25.

When assembled electrical module 14 includes a cylindrical shaped extension 18 which receives thereon handle shells 12A and 12B thereby forming the completed utility light as illustrated in FIG. 1. Post like protrusions 23A and 23B extend through an opening in extension 18, as illustrated in FIGS. 3 and 4, and are fastened by a screw 15. Two additional screws 15 extend through shell 12B and cord lock 22B, within shell 12B, and are received within cord lock 22A inside shell 12A as illustrated in FIGS. 2, 3 and 4.

Figure 5:
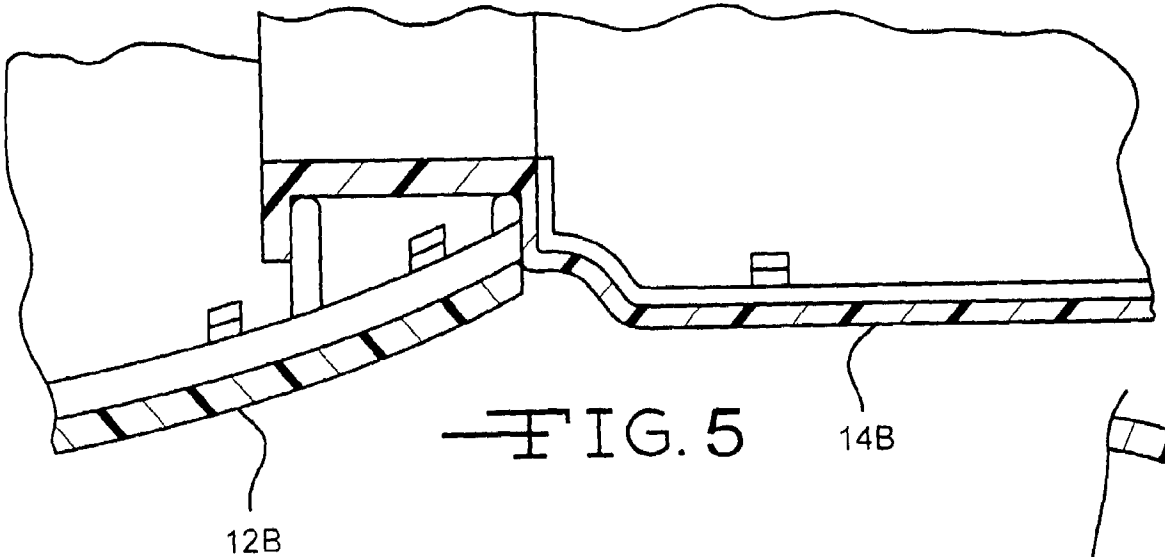
FIG. 5 presents a crossectional view taken along line 5-5 in FIG. 1.

Shells 12A and 12B, when assembled, further inter lock with extension 18 of electrical module 14 as illustrated in FIG. 5.

Once the electric module 14 has been designed, tested, and approved by UL, the module 14 may be joined with various handle configurations, thereby forming utility lights of various appearances and designs without undergoing individual UL testing and approval.

Although a specific embodiment of the invention has been disclosed, there is no intent to thereby limit the invention to the specific embodiment illustrated herein. On the contrary, the intention herein is to cover all modifications, alternatives, embodiments, and/or equivalents of the subject invention as may fall within the spirit and scope of the invention as disclosed.

I claim:

1. A modular utility light comprising:

a) an electrical module and a separate hand hold module, b) said electrical module containing therein electrical elements required to make said utility light electrically functional, c) said hand hold module including a first half shell and a second half shell that together, when assembled, form a body of said hand hold module, said assembled hand hold module interlocking with said electrical module thereby forming a utility light body.

2. The modular utility light of claim 1, further comprising a light bulb receptacle, wherein the electrical module comprises two opposing shells that encapsulate the electrical elements and the light bulb receptacle.

3. The modular utility light of claim 1, wherein the first half shell and the second half shell are assembled together with at least one fastener.

4. The modular utility light of claim 1, wherein the electrical components are brass electrical components.

5. The modular utility light of claim 1, wherein the hand hold module further comprises at least one cord lock.

6. The modular utility light of claim 5, wherein at least one screw extends through the at least one cord lock to fasten the first half shell of the hand hold module to the second half shell of the hand hold module.

7. The modular utility light of claim 1, wherein the electrical module comprises a cylindrical shaped extension, wherein the cylindrical shaped extension further comprises at least one opening.

8. The modular utility light of claim 7, wherein the hand hold module comprises at least one post like protrusion, wherein the at least one post like protrusion is configured to extend through the at least one opening in the cylindrical shaped extension of the electrical module.

9. The modular utility light of claim 8, wherein at least one screw extends through the at least one post like protrusion to fasten the first half shell of the hand hold module to the second half shell of the hand hold module.

* * * * *